US006240120B1

(12) United States Patent
Bebber et al.

(10) Patent No.: US 6,240,120 B1
(45) Date of Patent: May 29, 2001

(54) INDUCTIVE MELTING OF FINE METALLIC PARTICLES

(75) Inventors: Hans Bebber, Mülheim; Juan Fähnrich, Puhlheim-Sinthern; Günter Phillipps, Köln, all of (DE)

(73) Assignee: Induga Industrieofen und Giesserei-Anlagen GmbH & Co. KG, Cologne (DE)

( * ) Notice: Subject to any disclaimer, the term of this patent is extended or adjusted under 35 U.S.C. 154(b) by 0 days.

(21) Appl. No.: 09/582,298

(22) PCT Filed: Jan. 22, 1999

(86) PCT No.: PCT/DE99/00192

§ 371 Date: Jun. 22, 2000

§ 102(e) Date: Jun. 22, 2000

(87) PCT Pub. No.: WO99/41951

PCT Pub. Date: Aug. 19, 1999

(30) Foreign Application Priority Data

Feb. 12, 1998 (DE) ..... 198 05 644

(51) Int. Cl.[7] ..... H05B 6/16

(52) U.S. Cl. ..... 373/159; 373/161; 373/164; 373/146

(58) Field of Search ..... 373/138, 146, 373/147–150, 159–163; 75/10.14, 10.15, 10.19; 266/234

(56) References Cited

U.S. PATENT DOCUMENTS

| | | | |
|---|---|---|---|
| 1,838,527 | | 12/1931 | Clamer . |
| 4,571,258 | * | 2/1986 | Bamji et al. . |
| 5,479,436 | | 12/1995 | Hashida et al. . |

FOREIGN PATENT DOCUMENTS

| | | |
|---|---|---|
| 1 003 878 | 3/1957 | (DE) . |
| 2 128 742 | 12/1971 | (DE) . |
| 24 10 461 | 9/1975 | (DE) . |
| 36 17 303 C2 | 11/1987 | (DE) . |

* cited by examiner

*Primary Examiner*—Tu Ba Hoang
(74) *Attorney, Agent, or Firm*—Herbert Dubno; Andrew Wilford

(57) ABSTRACT

Fine metallic particles are melted in a furnace having an upper region surrounded by a crucible coil and a lower region forming a channel holding a core of a channel inductor. The particles are filled from above into the vessel while simultaneously electrically energizing the inductor with alternating current to inductively heat and fuse the particles and thereby form a melt in the vessel and electrically energizing the coil with alternating current to mix the melt in the vessel while energizing the inductor.

29 Claims, 1 Drawing Sheet

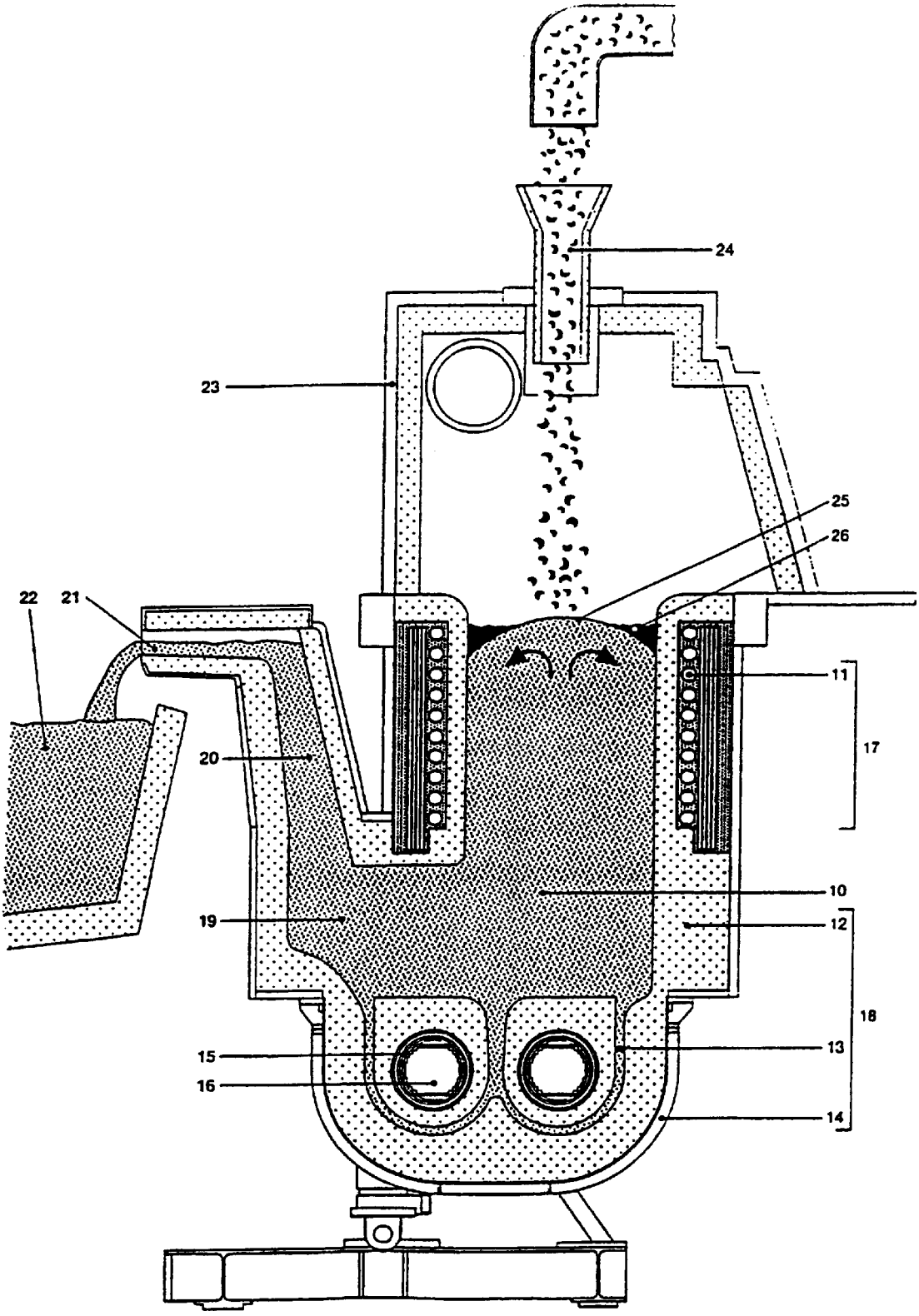
24
23
25
26
22
21
11
17
20
10
19
12
18
15
13
16
14

INDUCTIVE MELTING OF FINE METALLIC PARTICLES

CROSS REFERENCE TO RELATED APPLICATIONS

This application is the US national phase of PCT application PCT/DE99/00192 filed Jan. 22, 1999 with a claim to the priority of German patent application 19805644.3 itself filed Feb. 12, 1998.

FIELD OF THE INVENTION

The invention relates to a method and induction furnace for melting fine metallic and/or metal-containing particles, in particular chips of iron, copper, copper alloys, and/or aluminum and its alloys by means of inductive heating.

BACKGROUND OF THE INVENTION

In order to melt fine metallic and/or metal-containing particles, in particular chips produced by machining, according to the prior art two types of induction furnaces are known. Both types of furnaces are based on the use of magnetic induction.

It is standard to melt metal chips, in particular brass chips, in an induction crucible furnace comprised of a heat-resistant crucible surrounded by a water-cooled copper coil. This coil is energized with alternating current so as to produce an alternating magnetic field in the crucible charge which causes it to melt. The thus produced alternating field creates an intense mixing of the melt which pulls in metal particles added from above. In this manner, since the often oil-covered metal chips are rapidly pulled into the melt, metal losses of all types are minimized and there is minimal generation of toxic carbon compounds.

The currents in the magnetic coil and in the melt produce together with the magnetic field forces directed along the axis of the cylinder so that the upper surface of the melt is convex. Slag deposits itself annularly around the upper melt surface on the inner wall of the furnace, the thickness of the slag ring being smaller with greater movements of the melt.

As a result of the process the described crucible furnaces have the following disadvantages:

First the thermal efficiency of the crucible furnace is relatively low so that specific energy consumption is high. In addition the crucible furnace can only work in batches. Once the crucible furnace is full, the melt must be poured off before more metal can be melted. This produces down times that substantially reduce the capacity of the unit.

As a result of deposits on the walls of the crucible there is substantial cleaning work. Finally slag deposits on the crucible wall lead to intolerable losses in efficiency.

An alternative is the so-called channel furnace where the melt is held in a closed channel around the iron core of a low-frequency transformer. The melt forms the short-circuited secondary winding so that heat is produced by the high currents flowing in the melt. Such a channel-type furnace does mix the melt so that there is the danger of scorching of the metal when metal particles lying atop the melt are exposed to an oxidizing atmosphere. Plungers or mixers can be used to reduce scorching of the metal, but this entails a technical expense. Although the thermal efficiency of a channel furnace is considerable, only small melts can be processed since the mechanical mixing takes quite some time. As a rule only about 30% of the melt can be metallic scrap chips in order to achieve acceptable efficiency. Even so, like crucible furnaces, the channel furnaces work discontinuously. This also has the disadvantage of considerable down time.

OBJECTS OF THE INVENTION

It is therefore an object of the present invention to improve the above-described induction method and furnace while eliminating the above-mentioned disadvantages. In particular the aim is a continuous and efficient melting of metallic scrap particles and an induction furnace that takes little maintenance.

SUMMARY OF THE INVENTION

The solution according to the method is that the metallic particles are fed from above onto a melt in a furnace vessel and the melt is subjected in an upper region to mixing movements by an alternating field by means of a first magnet coil (crucible coil, mixing coil) surrounding the furnace vessel, the melt being simultaneously heated in a lower region in a melt channel around an iron core of a low-frequency transformer with a short-circuited secondary winding. The described method has the advantage that by means of an electrically energized crucible coil depending on the frequency of the supplied alternating voltage a strong mixing movement is produced to avoid burning of the metal and to minimize the amount of slag. The melting channel in which there is no mixing action can be thus optimally used with respect to its thermal efficiency. Overall the method according to the invention achieves a substantial energy saving of about 20%.

According to a further feature of the method of the invention the melt is continuously drawn off through a siphon with an inlet opening into the furnace vessel below the crucible coil at a rate preferably corresponding to an infeed rate of metal particles. This ensures a constant level of the upper surface of the melt so that the slag zone is always at the same region of the furnace wall and a thickening of the furnace wall as in crucible furnaces and the cleaning work related to it are avoided. The melting process can run continuously with a stabilized process.

Preferably there are no down times as with the prior-art methods for measuring and setting temperature, removing slag, emptying, and cleaning. As a result according to the invention one achieves an increase in productivity in the order of about 30% as well as an operating cost decrease of about 10%. The availability of the apparatus for production is substantially increased.

As already stated, the method of the invention makes it possible to use more than 50%, preferably 60% to 70%, of the overall electrical heating energy for producing the melt in the channel and the remainder in the crucible coil, so that the higher thermal efficiency is used by energy transfer in the channel.

According to construction of the siphon it can if necessary be heated.

Preferably the melt is drawn off from an outlet of the siphon at an acute angle to the vertical or vertically according to the principle of communicating tubes. Thus according to a further feature of the invention the siphon inlet is so positioned relative to the channel inductor that its heating and mixing action are effective in the siphon inlet. With this feature it is possible to convey heat from the furnace via the melt into the siphon so that heating of the siphon can be eliminated. In the employed furnace vessel the melt level is kept at the same height as the outlet of the siphon. To the extent that metallic particles are melted, melt flows out of the siphon outlet into a ladle. With such a continuous method no cleaning of the furnace wall is necessary, so that down times for the furnace are eliminated.

Preferably a melt diameter determined by the furnace vessel is so large that a slag-free convex upper melt surface produced by the mixing action is greater in diameter than twice the width of a ring of slag sitting at the edge of the vessel. The diameter of the so-called crown relative to the slag-ring width can be influenced by the frequency and power of the alternating field, which is set by the crucible coil. Lower frequencies in the region of line frequency are advantageous since they promote mixing. In order to avoid scorching the metal the added metallic particles are fed exclusively to the convex slag-free melt upper surface, preferably by a funnel.

According to a particular embodiment of the invention the crucible coil is supplied with alternating current at a frequency of 50 to 250 Hz, preferably 50 to 120 Hz, and the channel inductor with an alternating current at a frequency of 50 to 60 Hz.

The apparatus achieves the described object with the induction furnace of the invention that is characterized in that the furnace is formed in an upper region with a single chamber as a crucible-type induction furnace and in a lower region is formed as a channel-type induction furnace.

Thus the induction furnace has a siphon having an inlet below a crucible coil of the induction-type crucible region. The siphon extends vertically or at an acute angle to the vertical and has an outlet above the crucible coil. This avoids a long flow path which the fluent melt otherwise would have to go through from the furnace to the outlet. In addition this arrangement uses heat convection and movement throughout the melt in the furnace.

If necessary the siphon is heat insulated and/or is heatable by means of an induction or resistance heater. Preferably the siphon outlet diameter is at least 150 mm.

In a further embodiment of the induction furnace a ratio of the mixing-coil height to the mixing-coil diameter is 1:2, with a positive or negative variance up to ±20%.

In a first embodiment of the induction furnace according to the invention the channel of the channel-furnace region is perpendicular to the siphon and the channel inductor is horizontal. it is also possible to orient the channel inductor or the channel at an angle generally in order to encourage flow of the melt toward the outlet of the siphon. Of course the channel inductor can be set at 90° to the siphon.

BRIEF DESCRIPTION OF THE DRAWING

An embodiment of an induction furnace according to the invention is shown in the drawing in section.

SPECIFIC DESCRIPTION

The induction furnace according to the invention has a single melt chamber 10 whose upper region is surrounded by a water-cooled crucible winding 11. The furnace itself has according to the prior art a heat-proof lining 12. A lower region of the furnace is formed as a channel 13 that is heated by means of a channel inductor 14. This channel inductor 14 is comprised of magnetic coils 15 around an iron core 16. This construction produces an upper region 17 which constitutes an induction-type crucible furnace and a lower region which is an induction-type channel furnace. Below the crucible coil 11 but above the channel 13 the induction furnace has an outlet, here an opening 19 of a siphon 20 whose longitudinal axis extends at an acute angle to the vertical. A siphon overflow outlet 21 is above the crucible coil 11. From it melt can flow into a ladle 22 or the like. Electrical current is supplied to the crucible coil 11 and to the channel inductors 14 by lines shown at 23. The induction furnace and method according to the invention function as follows:

A loading device such as a funnel 24 supplies metal chips to the so-called crown 25, that is the slag-free convex top of the melt that is surrounded by the slag ring 26. The supply of metal chips is such that the metal chips all fall on the crown 25. The crucible coil which is energized at a frequency between 50 Hz and 120 Hz sets the melt in motion so that the metal particles or chips lying on the crown 25 are entrained into the melt. The melting of fine metallic particles thus takes place in the melt so that burning of the metal is avoided. Preferably only about a third of the heat supplied to the induction furnace is applied to the crucible coil 11, two thirds of this heat going to the channel inductors 14. According to the principle of communicating tubes, a melt column forms in the siphon which rises to the level of the melt upper surface 25. When the induction furnace is filled as shown, adding further metal chips produces a corresponding melt flow out of the overflow 21. The process can be controlled such that the heat capacity is great enough to completely melt the added metal chips. Processible chips can in particular be comprised of iron, copper, aluminum and their alloys. The method according to the invention is also usable for metal-containing scrap that is found in the recycling of waste material such as ash, filter powder, etc.

In an actual embodiment the induction furnace has a capacity of 2 MW, 1100 kW being supplied to the channel and 900 kW to the crucible coil 11. With appropriate dimensioning of the furnace 8 t/h of brass chips can be melted. The system is 20% more energy efficient than a standard crucible furnace.

What is claimed is:

1. A method of melting fine metallic particles by inductive heating wherein the metallic particles are fed from above onto a melt in a furnace vessel and the melt is subjected in an upper region to mixing movements by an alternating field by means of a first magnet crucible coil surrounding the furnace vessel, the melt being simultaneously heated in a lower region in a melt channel around an iron core of a low-frequency transformer with a short-circuited secondary winding.

2. The method according to claim 1 wherein the melt is continuously drawn off through a siphon with an inlet opening into the furnace vessel below the crucible coil at a rate corresponding to an infeed rate of metal particles.

3. The method according to claim 1 wherein more than 50% of the overall electrical heating energy is applied to the melt in the channel and the remainder to the crucible coil.

4. The method according to claim 2 wherein the siphon is heated by an inductive or resistance heater.

5. The method according to claim 2 wherein the melt is drawn off from an outlet of the siphon at an acute angle to the vertical.

6. The method according to claim 5 wherein the siphon inlet is positioned relative to the crucible coil such that the mixing movements of the melt are effective in the siphon inlet.

7. The method according to claim 1 wherein a melt diameter determined by the furnace vessel is so large that a slag-free convex upper melt surface produced by mixing action is greater in diameter than twice the width of a ring of slag sitting at the edge of the vessel.

8. The method according to claim 7 wherein the metal particles are fed exclusively to the convex slag-free melt upper surface.

9. The method according to claim 1 wherein the crucible coil is supplied with alternating current at a frequency of 50 to 250 Hz and the transformer with an alternating current at a frequency of 50 to 60 Hz.

10. An induction furnace for continuously melting fine metal particles wherein the furnace is formed in an upper region with a single chamber as a crucible-type induction furnace with a crucible mixing coil and in a lower region is formed as a channel-type induction furnace, the furnace further comprising:

a siphon having an inlet below the crucible coil and extending vertically or at an acute angle to the vertical and has an outlet above the crucible coil.

11. The induction furnace according to claim 10 wherein the siphon is heat insulated.

12. The induction furnace according to claim 10 wherein the siphon outlet has a diameter of at least 150 mm.

13. The induction furnace according to claim 10 wherein a ratio of a mixing-coil height to a mixing-coil diameter is 1:2.

14. The induction furnace according to claim 10 wherein the channel of the channel-furnace region is perpendicular to the siphon.

15. The induction furnace according to claim 10 wherein the channel is transverse to an axis of the siphon.

16. The induction furnace according to claim 10 wherein the channel is set at 90° to the vertical.

17. A method of inductively melting fine metallic particles, the method comprising the steps of:

providing a furnace vessel with an upper region surrounded by a crucible coil and a lower region forming a channel holding a core of a channel inductor;

filling the particles from above into the vessel; and simultaneously electrically energizing the inductor with alternating current to inductively heat and fuse the particles and thereby form a melt in the vessel and electrically energizing the coil with alternating current to mix the melt in the vessel while energizing the inductor.

18. The inductive-melting method defined in claim 17 wherein the particles are continuously filled from above into the vessel at a predetermined mass/time rate, the method further comprising the step of:

continuously drawing the melt out of the lower region of the vessel at a mass/time rate generally corresponding to the mass/time rate at which particles are filled into the vessel.

19. The inductive-melting method defined in claim 18 wherein the melt is drawn out of the lower region through a passage having an inlet end in the lower region and an outlet end above the crucible coil.

20. The inductive-melting method defined in claim 17 wherein the vessel has a diameter at an upper surface of the melt and the crucible coil is energized such that the upper surface forms an upwardly convex crown surrounded by a ring of slag, the particles are filled into the vessel onto the crown within the ring.

21. The inductive-melting method defined in claim 17 wherein the crucible coil is energized with alternating current at between 50 Hz and 250 Hz.

22. The inductive-melting method defined in claim 17 wherein the channel inductor is energized with alternating current at between 50 Hz and 60 Hz.

23. The inductive-melting method defined in claim 17 wherein the channel inductor is energized with substantially more electrical energy than the crucible coil.

24. An inductive furnace for melting metallic particles, the furnace comprising:

an upwardly open vessel having an upper region and a lower channel-shaped region;

means for filling the metallic particles into the vessel;

a crucible coil surrounding only the upper region of the vessel;

a core of a channel inductor in the lower region;

means for electrically energizing both the coil and the channel inductor and thereby melting the particles into a melt and mixing the melt in the upper region; and means including a passage having a lower end opening into the vessel below the crucible coil and an upper outlet end outside the vessel above the crucible coil for drawing the melt out of the vessel.

25. The inductive furnace defined in claim 24 wherein the upper outlet end has a diameter of at least 150 mm.

26. The inductive furnace defined in claim 24 wherein the passage extends generally vertically between its ends.

27. The inductive furnace defined in claim 24 wherein the passage is insulated.

28. The inductive furnace defined in claim 24 wherein the channel-shaped region is generally horizontal.

29. The inductive furnace defined in claim 24 wherein the coil has a height and a diameter forming a ratio of about 1:2.

* * * * *